US011549328B2

(12) United States Patent
Schneider

(10) Patent No.: US 11,549,328 B2
(45) Date of Patent: Jan. 10, 2023

(54) OVER ELEMENT LINE PROTECTOR AND METHOD

(71) Applicant: David Schneider, Conroe, TX (US)

(72) Inventor: David Schneider, Conroe, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 128 days.

(21) Appl. No.: 17/062,986

(22) Filed: Oct. 5, 2020

(65) Prior Publication Data

US 2022/0106852 A1 Apr. 7, 2022

(51) Int. Cl.
*E21B 33/12* (2006.01)
*E21B 17/10* (2006.01)

(52) U.S. Cl.
CPC ..... *E21B 33/12* (2013.01); *E21B 17/1035* (2013.01); *E21B 17/1085* (2013.01)

(58) Field of Classification Search
CPC ..... E21B 17/1085; E21B 17/1035
See application file for complete search history.

(56) References Cited

U.S. PATENT DOCUMENTS 1,383,777 A * 7/1921 Stephens ..... E21B 36/04 174/136
7,311,154 B2 * 12/2007 Cho ..... E21B 17/026 166/241.1
7,431,085 B2 * 10/2008 Coronado ..... E21B 43/04 166/278
7,784,537 B2 * 8/2010 Baxter ..... B21D 43/28 166/241.5
2009/0283273 A1 * 11/2009 Head ..... E21B 23/02 166/179

* cited by examiner

*Primary Examiner* — Catherine Loikith
(74) *Attorney, Agent, or Firm* — Cantor Colburn LLP

(57) ABSTRACT

An over element line protector comprises a body having a first major surface including a first curvature of a first radius and a second major surface including a second curvature having a second smaller radius. The second radius is smaller than the first radius. The body has a longitudinal extent and a central region aligned with and along the longitudinal extent. The central region is of a first thickness. Wing regions extend laterally from the central region and have a second smaller thickness than the first thickness. A passageway is located in the central region extending along the longitudinal extent of the body configured to protect a line therein.

20 Claims, 7 Drawing Sheets

OVER ELEMENT LINE PROTECTOR AND METHOD

BACKGROUND

In the resource recovery industry packers are common devices that include elements designed to seal an annular space between two tubular shapes such as a tubing string and a casing or open hole. Lines such as control lines and electrical lines often need to extend past such elements. Traditional thinking required that the lines be disposed radially inwardly of or through the element at the time of manufacture to ensure sealing and protection thereof but that method also requires that line stubs extending from the element require splicing at the rig site. While the traditional method works well, it does require significant rig time and hence is a costly method. The art would well receive alternatives that save rig time and cost while maintaining functionality.

SUMMARY

An embodiment of an over element line protector comprising of a body having a first major surface including a first curvature of a first radius and a second major surface including a second curvature having a second smaller radius, the second radius being smaller than the first radius, the body having a longitudinal extent and a central region aligned with and along the longitudinal extent having a first thickness and wing regions on both lateral sides of the central region of a second smaller thickness; a passageway located in the central region extending along the longitudinal extent of the body configured to protect a line therein.

An embodiment of a method for installing lines over an element in a packer system without splicing comprising of placing a line extending along the packer system into a passageway of the protector of any prior embodiment; and attaching the protector to the packer system over the element.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
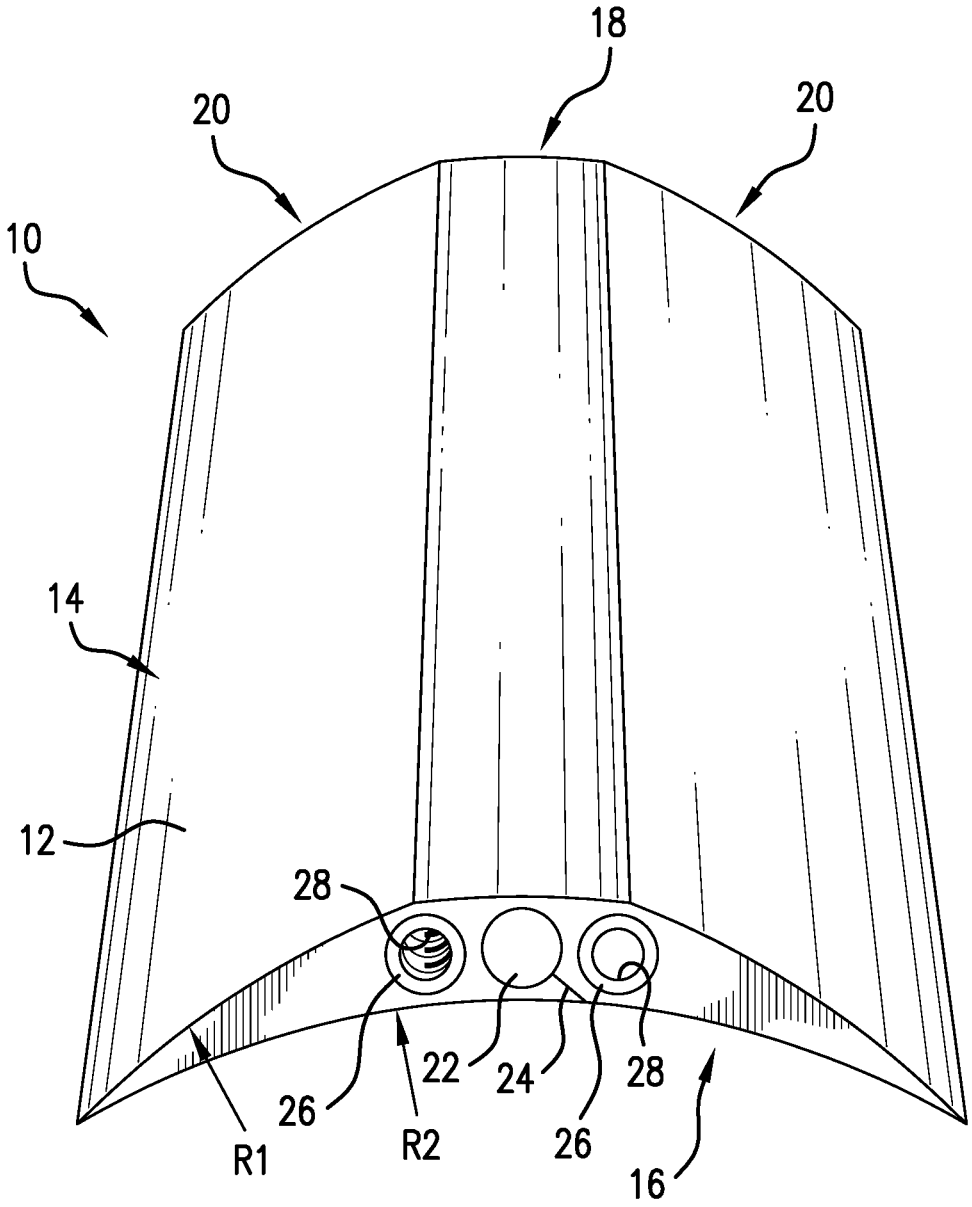
FIG. 1 is a perspective view of an embodiment of an over the element line protector as disclosed herein.

Referring to FIG. 1 an over the element line protector 10 is illustrated. Protector 10 is intended to protect a line that is routed to the outside of an element of a packer system. As noted above, the lines are usually routed beneath the element where they are protected but routing outside of the element while being unprotected allows for much more rapid deployment since splicing of the lines above and below the packer system would not be required. Unprotected however, the lines at the outside of the element run a very significant risk of damage or complete destruction during running and or setting of the packer system. Protector 10 eliminates the problem by configuring a body 12 with a first major surface 14 that includes at least one first radius (R1). In an embodiment, the first radius is selected to be similar to a structure in which the packer system is to be set. and a second major surface 16 that includes at least one second radius (R2), the second radius being smaller than the first radius. The body 12, then, is configured to nest against an outside of a packer system between the element and the casing. The body 12 exhibits a longitudinal extent and comprises a central region 18 that is aligned with and extends along the longitudinal extent of the body 12. In an embodiment, the thickness of the body 12 in the central region 18 is sufficient to enclose a line completely. At either lateral side of the central region 18 are wing regions 20. The wing regions 20 have a thickness where they adjoin the central region 18 that is a close approximation thereof and at opposite sides of the wing regions 20 have a very small thickness. The wing regions 20 hence are tapered in either direction coming from the central region 18. This helps with sealing when the element is being set. The protector 10 may be constructed of rubber, plastic, polymeric, monomeric, elastomeric, or similar materials that have at least some resilience and flexibility.

Within the body 12 and configured to receive a line, such as a hydraulic line or electric line, etc. is a passageway 22 (or a plurality of passageways). The line, then, would be protected within the passageway 22 after installation therein. In embodiments, the passageway 22 also includes an access feature 24 that allows easy access for the line to the passageway 22. The access feature 24 as illustrated is a slit in the material of the body 12 but it is noted that it could be a small gap in the material of the body 12 as well providing consideration is given for fluid tight sealing, such as an additional strip of sealing material to close the gap after insertion of the line therein. In one embodiment, the access feature 24 is disposed at an angle through the body 12 and intersecting the passageway 22 as can be seen in the illustration of FIG. 1. While the slit is shown extending from the passageway 22 to the second major surface 16, it is to be appreciated that the slit could also extend between the passageway 22 and the first major surface if needed. It should also be appreciated that a slit could be formed onsite as well as at a factory using a suitable sharp instrument.

Figure 2:
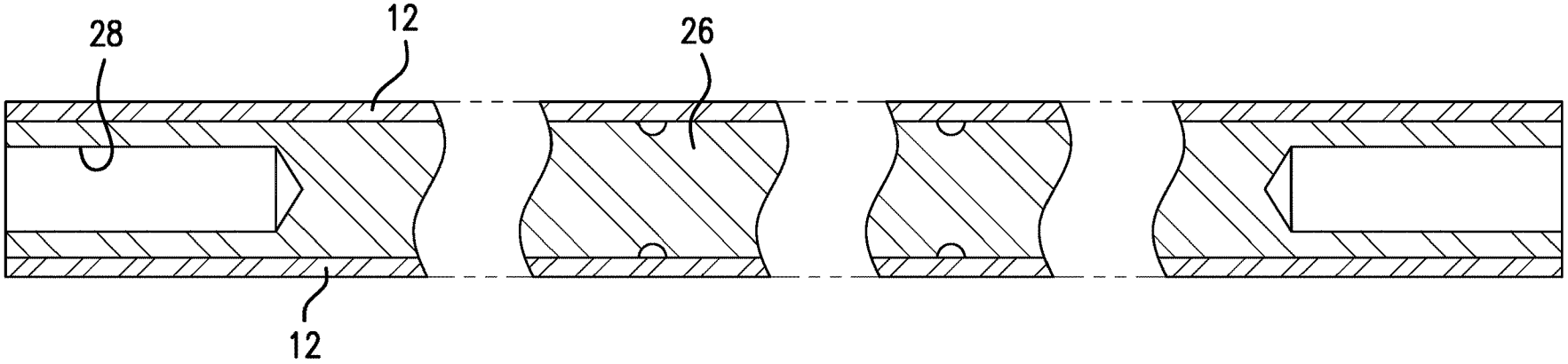
FIG. 2 is a section view of an optional reinforcing member of the over the element line protector illustrated in FIG. 1.

Optionally, and referring to FIGS. 1 and 2, the protector 10 may also include one or more reinforcing members 26. The members 26 extend along the passageway 22 to provide for stiffening and crush resistance of the central region 18 about the passageway 22 for both running and setting. The members 26 may be constructed of metal, plastic, wire rope, etc. In an embodiment, the reinforcing member 26 will also include a hold down feature 28 at ends thereof. The hold down feature is intended to provide for a way to ensure the protector 10 does not move while running. The hold down feature 28 may be configured as a recess that may be smooth bored or may be threaded, for example. The recess is configured to accept a bracket configured for the purpose. While recesses in the ends of the reinforcing members 26 are illustrated, it is to be understood that the reinforcing member could easily simply be a tubular structure to provide the equivalent of the recess without boring one.

Figure 3:
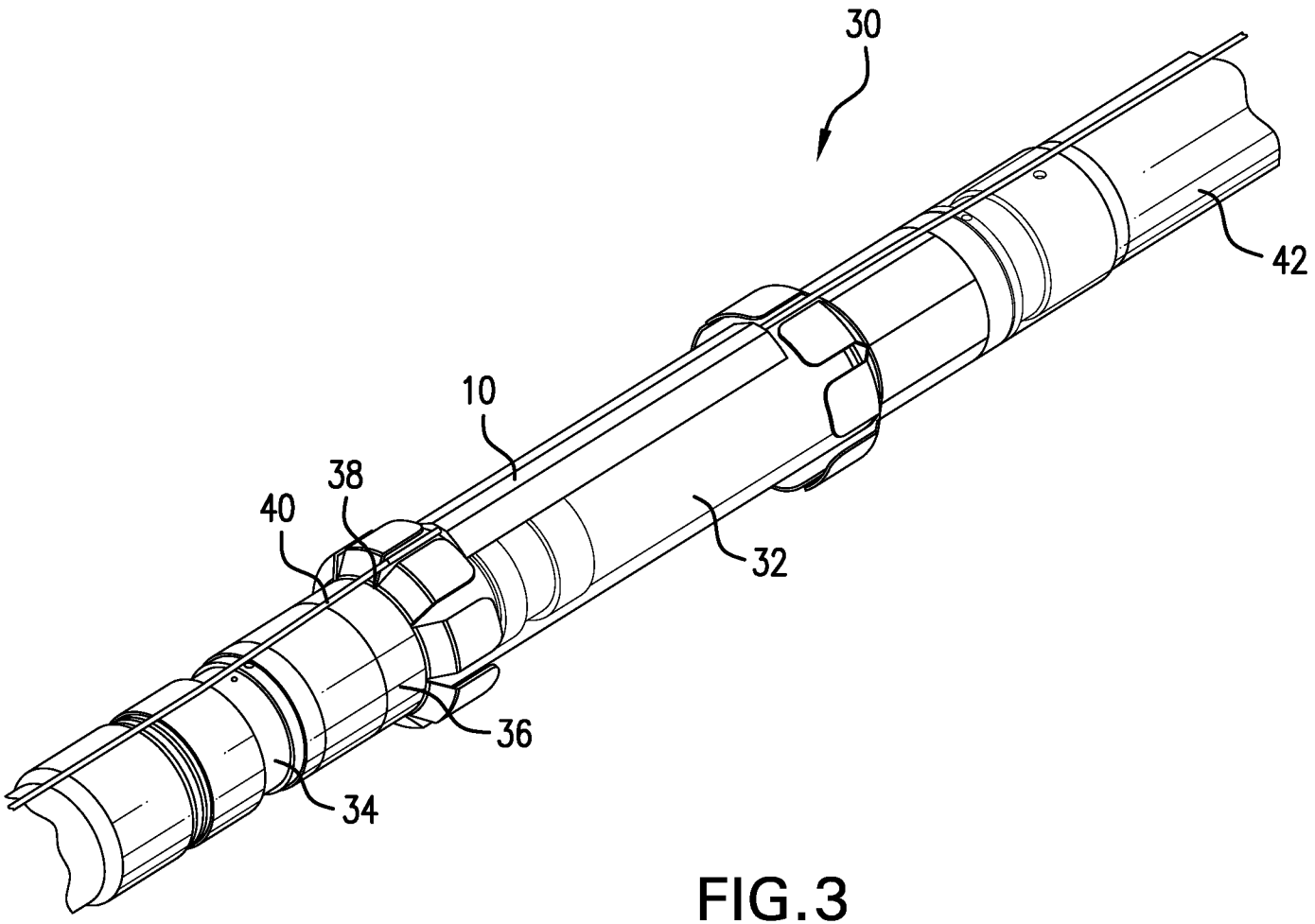
FIG. 3 is a perspective view of a packer system including the over the element line protector as disclosed herein.
Figure 4:
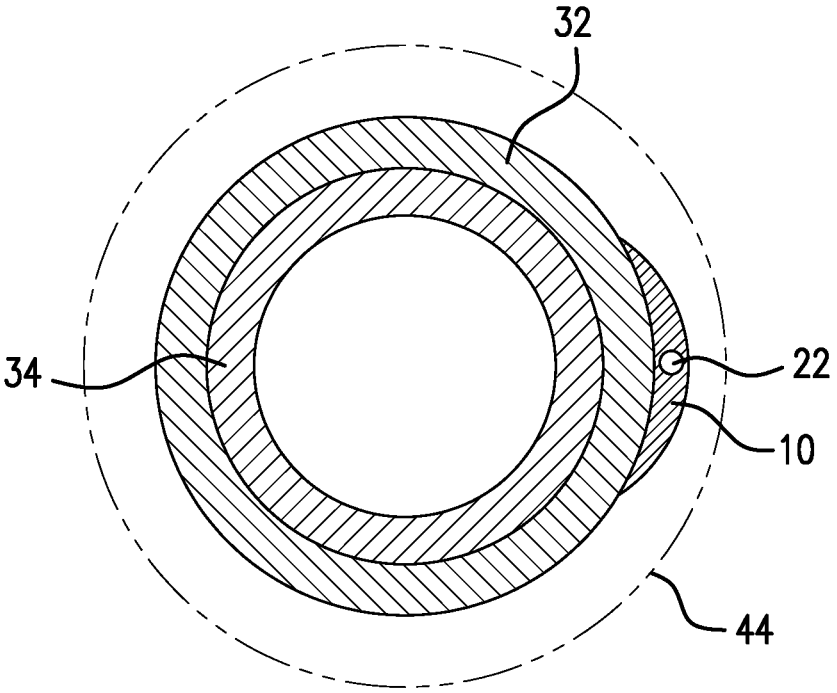
FIG. 4 is a schematic end view illustrating a packer system like that of FIG. 3 in an unset position within a casing.
Figure 5:
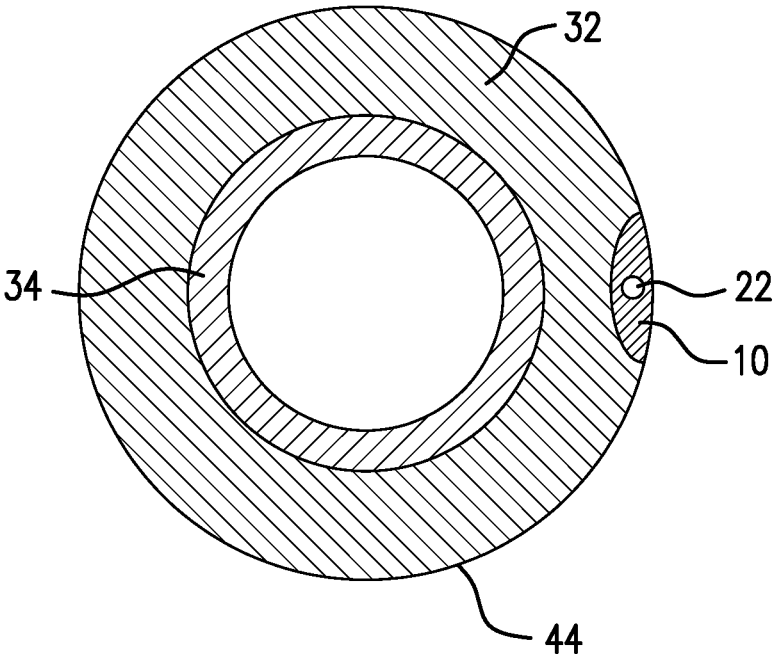
FIG. 5 is a schematic end view illustrating a packer system like that of FIG. 3 in a set position within the same casing.

Having described the protector 10 on its own, reference is made to FIG. 3 wherein the protector 10 is illustrated as a part of a packer system 30. System 30 includes an element 32 disposed about a mandrel 34. An example of backups 36 are also illustrated with petals 38. Other backup styles are contemplated. A line 40 is also illustrated extending along the system 30 and a tubing string 42 in which the system 30 is installed. It will be appreciated that the line 40 includes no splices at ends of the element 32 and that the line 40 is positioned at an outside diameter of the element 32. Line 40 extends into the protector 10 and extends from each end of protector 10. Reference to FIGS. 4 and 5 provides another perspective on understanding the components introduced above and their relative positions. FIG. 4 illustrated the system 30 in an unset/running position and FIG. 5 illustrated the system 30 in a set position. Each of FIGS. 4 and 5 includes a representation of a casing 44 in which the system 30 is set. It is to be understood that the casing 44 illustrated is intended to be viewed as a tubular member or an open borehole wall. The configuration of the protector 10 on the element 32 in FIG. 4 shows the protector at an outside surface of the element and standing proud thereof, which provides the room for line 40 protection within the central region 18 of protector 10. Then upon setting as shown in FIG. 5, the protector 10 is compressed into the casing 44 by the radial expansion of the element 32. The element 32 forces the protector 10 into the casing 44 and deforms around the protector 10 to ensure a pressure tight seal between the system 30 and the casing 44.

In use, the protector 10 is placed upon the element 32 in the field and the line 40 is urged into the protector 10 through the access feature 24. In order for this to occur, either the line must be unencumbered by other protective matter or must be freed or exposed from that protective matter such as being stripped out of a flat pack for example. This is to ensure that the line 40 will seal to the protector by having a smooth outside surface rather than for example a rougher or textured flat pack outer surface. Once the line 40 is disposed within the passageway 22 of the protector 10, the protector 10 is placed against an outside surface of the element 32 and secured there using the hold down features 28 and suitable bands 56 or clamps. It is to be appreciated that bands and or clamps are configured to maintain the line in place during running but to yield under the forces used to set the element so that the bands or clamps or both will not interfere with the setting of the element. The level of force resistance needed can be obtained through material, geometry or both.

Figure 6:
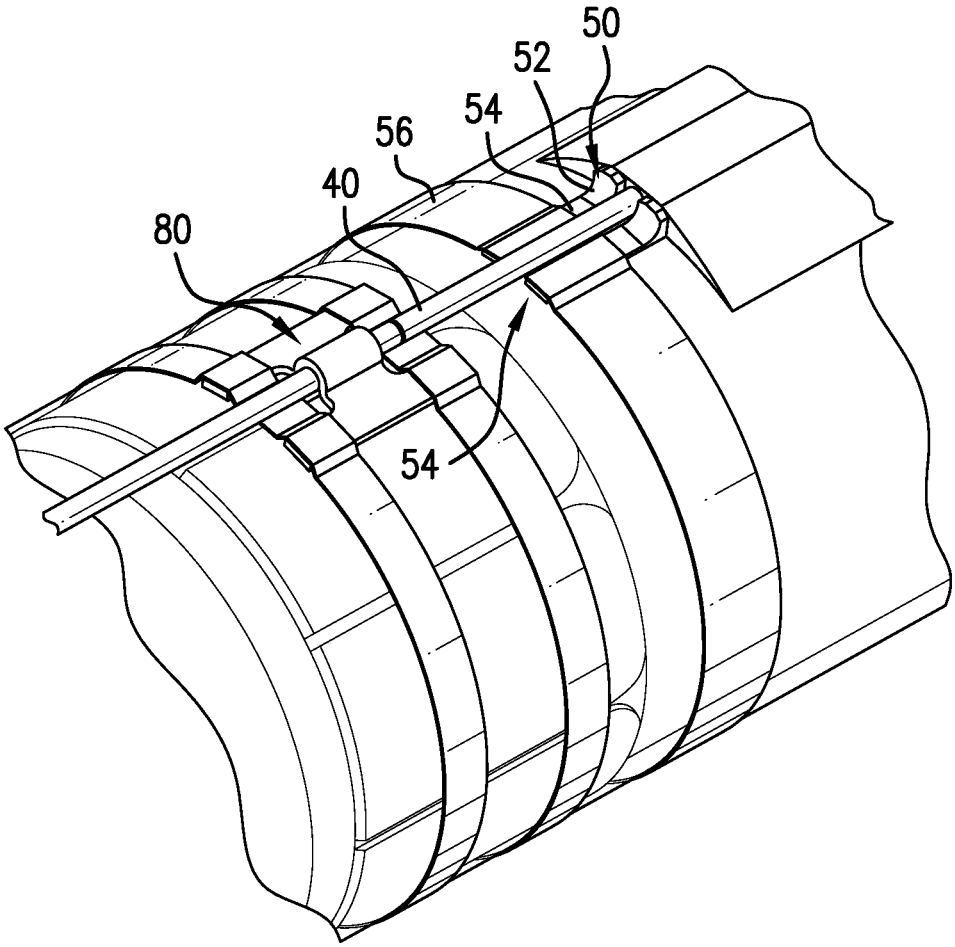
FIG. 6 is a view of embodiments including brackets that interact with hold downs of the over the element line protector as disclosed herein.
Figure 7:
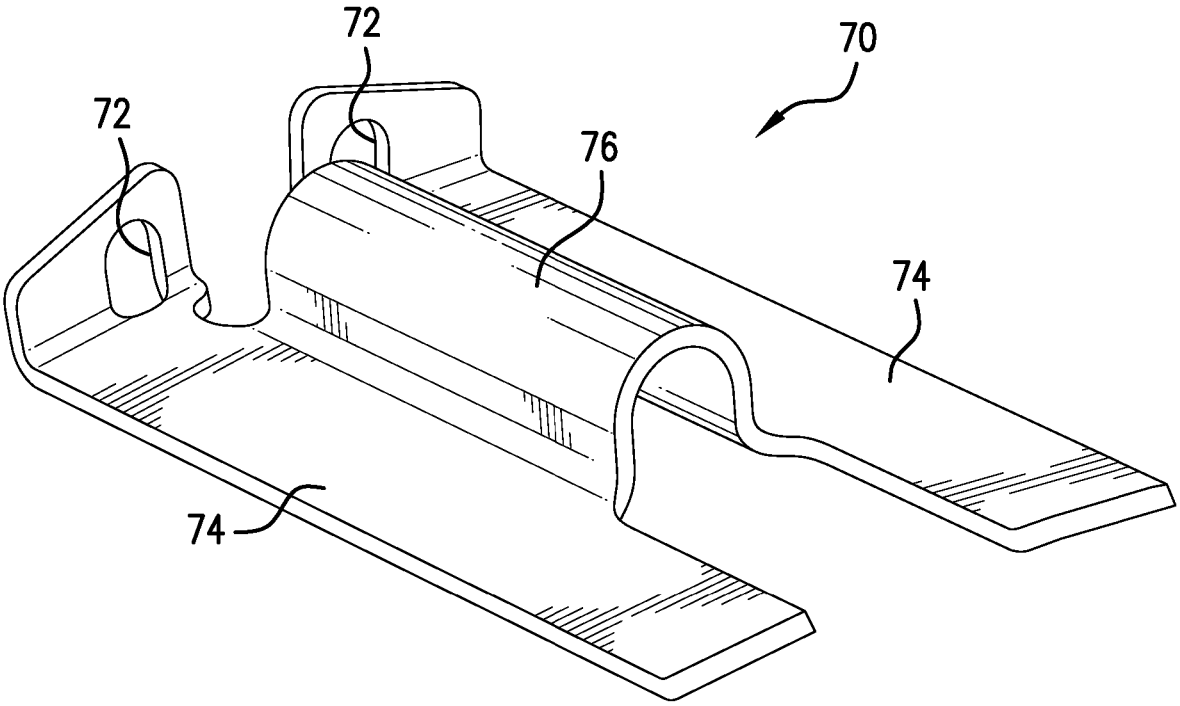
FIG. 7 is an alternative bracket.

Returning to the hold down feature 28 introduced above and referring now to FIGS. 6 and 7, embodiments of hold down feature brackets 50 are illustrated. In FIG. 6, the bracket extends into the hold down feature 28 and provides a gusset 52 and a leg 54. These are contained against the element 32 by a band 56 thereby securing the protector 10 to the outside of the element 32. A similar but distinct bracket 70 is seen in FIG. 7. This bracket configuration provides openings 72 for fasteners (not shown) that are receivable in the hold down feature 28. The legs 74 are similar to legs 54 and interact with the band 56 in the same way as in FIG. 6. This bracket 70 also includes a tunnel 76 for the line passing therethrough which departs from the configuration of FIG. 6 where the line is exposed.

Referring again to FIG. 6, it is noted that another bracket 80 may be employed to further secure the line 40. The features of this bracket 80 are quite similar to features of the brackets 50 and 70 and hence do not require further discussion.

Figure 8:
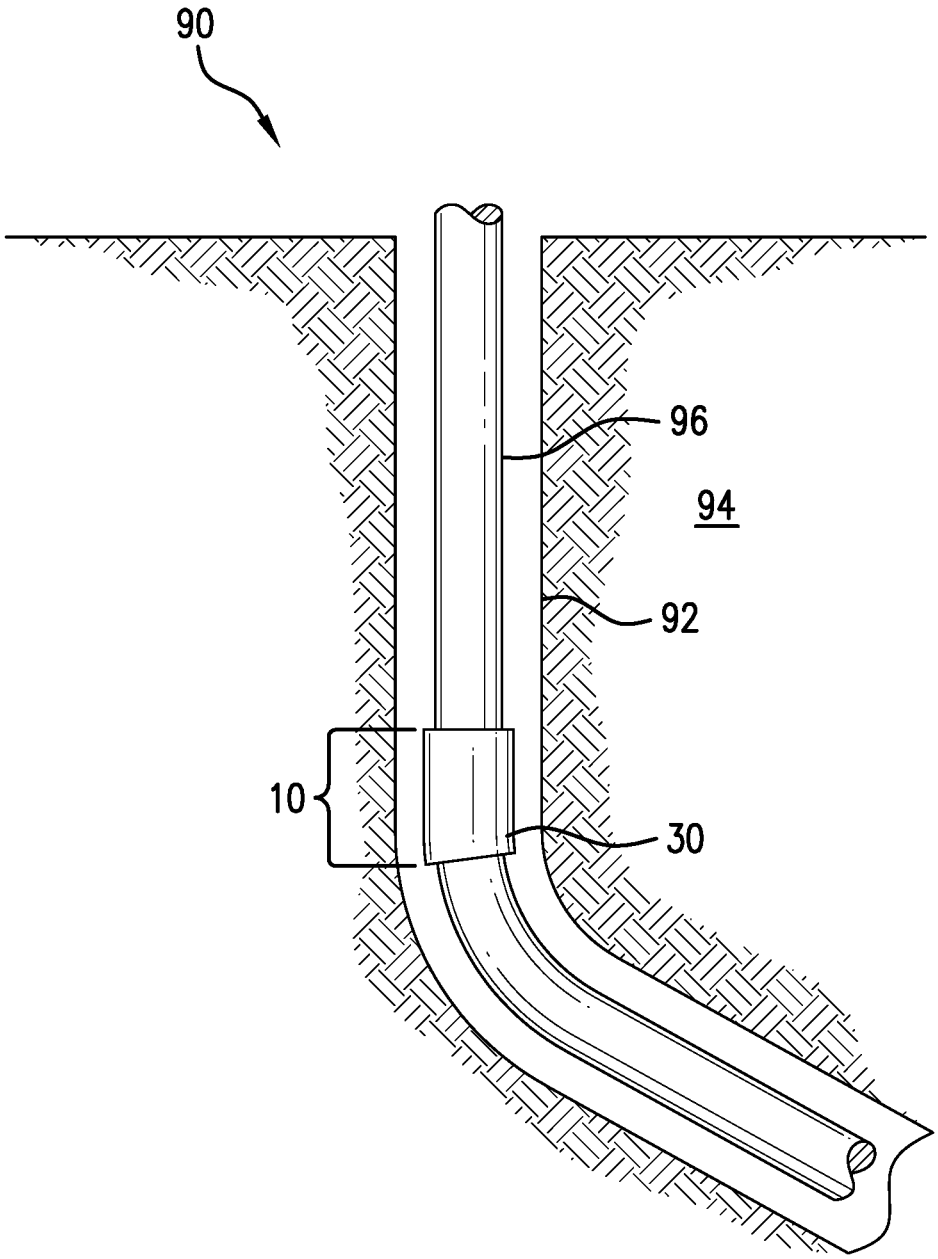
FIG. 8 is a wellbore system employing the over the element line protector as disclosed herein.

Finally, referring to FIG. 8, a schematic representation of a wellbore system 90 is provided wherein a borehole 92 (cased or uncased) in a formation 94 is presented with a tubing string 96 therein. The tubing string 96 includes a packer system 30 that includes a protector 10 thereon as described hereinabove.

Set forth below are some embodiments of the foregoing disclosure:

Embodiment 1: An embodiment of an over element line protector comprising of a body having a first major surface including a first curvature of a first radius and a second major surface including a second curvature having a second smaller radius, the second radius being smaller than the first radius, the body having a longitudinal extent and a central region aligned with and along the longitudinal extent having a first thickness and wing regions on both lateral sides of the central region of a second smaller thickness; a passageway located in the central region extending along the longitudinal extent of the body configured to protect a line therein.

Embodiment 2: The over element line protector of any prior embodiment wherein the wing regions thickness diminishes with distance from the central region.

Embodiment 3: The over element line protector of any prior embodiment wherein the thickness diminishes to a point.

Embodiment 4: The over element line protector of any prior embodiment further including an access feature laterally through the body to the passageway.

Embodiment 5: The over element line protector of any prior embodiment wherein the access feature is a slit through the material of the body from either the first or second major surface to the passageway.

Embodiment 6: The over element line protector of any prior embodiment wherein the slit is at an angle relative to a position of the passageway.

Embodiment 7: The over element line protector of any prior embodiment wherein the body further includes a reinforcing member disposed in the body.

Embodiment 8: The over element line protector of any prior embodiment wherein the reinforcing member runs parallel to the passageway.

Embodiment 9: The over element line protector of any prior embodiment wherein the reinforcing member includes a hold down feature.

Embodiment 10: The over element line protector of any prior embodiment wherein the hold down feature is a recess.

Embodiment 11: The over element line protector of any prior embodiment wherein the recess is threaded.

Embodiment 12: An embodiment of a method for installing lines over an element in a packer system without splicing comprising: placing a line extending along the packer system into a passageway of the protector of any prior embodiment; and attaching the protector to the packer system over the element.

Embodiment 13: The method of any prior embodiment further including exposing the line from a flat pack.

Embodiment 14: The method of any prior embodiment wherein the placing is forcing the line through an access feature into the protector.

Embodiment 15: The method of any prior embodiment further including engaging a hold down to secure the protector to the packer system.

Embodiment 16: An embodiment of a packer system comprising of a mandrel; an element disposed about the mandrel; the over element line protector as claimed in any prior embodiment disposed over the element, protecting a line without a splice at the packer system.

Embodiment 17: The system of any prior embodiment wherein the protector includes a reinforcing member.

Embodiment 18: The system of any prior embodiment wherein the reinforcing member further comprises a hold down to secure the protector to the element.

Embodiment 19: A embodiment of a wellbore system comprising of a borehole in a subsurface formation; a packer system disposed in the borehole; and the over element line protector as claimed in any prior embodiment disposed about the packer system wherein the line extends over an element of the packer system without a splice.

Embodiment 20: The wellbore system of any prior embodiment wherein the over element line protector system further includes a reinforcing member with a hold down securing the over element line protector to the packer system.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An over element line protector comprising:

a body having a first major surface including a first curvature of a first radius and a second major surface including a second curvature having a second radius, the second radius being smaller than the first radius, the second major surface configured to nest with an element upon which the protector is placed, the body having a longitudinal extent and a central region aligned with and along the longitudinal extent having a first thickness and wing regions on both lateral sides of the central region of a second smaller thickness; and a passageway located in the central region extending along the longitudinal extent of the body configured to protect a line therein.

2. The over element line protector as claimed in claim 1 wherein the wing regions thickness diminishes with distance from the central region.

3. The over element line protector as claimed in claim 2 wherein the wing regions thickness diminishes to a point.

4. The over element line protector as claimed in claim 1 further including an access feature laterally through the body to the passageway.

5. The over element line protector as claimed in claim 4 wherein the access feature is a slit through a material of the body from either the first or second major surface to the passageway.

6. The over element line protector as claimed in claim 5 wherein the slit is at an angle relative to a position of the passageway.

7. The over element line protector as claimed in claim 1 wherein the body further includes a reinforcing member disposed in the body.

8. The over element line protector as claimed in claim 7 wherein the reinforcing member runs parallel to the passageway.

9. The over element line protector as claimed in claim 7 wherein the reinforcing member includes a hold down feature.

10. The over element line protector as claimed in claim 9 wherein the hold down feature is a recess.

11. The over element line protector as claimed in claim 10 wherein the recess is threaded.

12. A method for installing lines over an element in a packer system without splicing comprising:

placing a line extending along the packer system into a passageway of a protector as claimed in claim 1; and attaching the protector to the packer system over the element.

13. The method as claimed in claim 12 further including exposing the line from a flat pack.

14. The method as claimed in claim 12 wherein the placing is forcing the line through an access feature into the protector.

15. The method as claimed in claim 12 further including engaging a hold down to secure the protector to the packer system.

16. A packer system comprising:

a mandrel;

an element disposed about the mandrel; and an over element line protector as claimed in claim 1 disposed over the element protecting a line without a splice at the packer system.

17. The system as claimed in claim 16 wherein the protector includes a reinforcing member.

18. The system as claimed in claim 17 wherein the reinforcing member further comprises a hold down to secure the protector to the element.

19. A wellbore system comprising:

a borehole in a subsurface formation;

a packer system disposed in the borehole; and an over element line protector as claimed in claim 1 disposed about the packer system wherein the line extends over an element of the packer system without a splice.

20. The wellbore system as claimed in claim 19 wherein the over element line protector system further includes a reinforcing member with a hold down securing the over element line protector to the packer system.

* * * * *